US010276940B2

(12) United States Patent
Williams et al.

(10) Patent No.: US 10,276,940 B2
(45) Date of Patent: Apr. 30, 2019

(54) MULTI-BAND SUBSCRIBER ANTENNA FOR PORTABLE RADIOS

(71) Applicant: MOTOROLA SOLUTIONS, INC, Schaumburg, IL (US)

(72) Inventors: William R. Williams, Coral Springs, FL (US); Nereydo T Contreras, Fort Lauderdale, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 554 days.

(21) Appl. No.: 14/069,117

(22) Filed: Oct. 31, 2013

(65) Prior Publication Data

US 2015/0116181 A1 Apr. 30, 2015

(51) Int. Cl.

| | |
|---|---|
| ***H01Q 1/24*** | (2006.01) |
| ***H01Q 9/30*** | (2006.01) |
| ***H01Q 11/08*** | (2006.01) |

(52) U.S. Cl.

CPC ..... *H01Q 9/30* (2013.01); *H01Q 1/242* (2013.01); *H01Q 11/08* (2013.01)

(58) Field of Classification Search

CPC ..... H01Q 9/30; H01Q 1/242; H01Q 11/08
USPC ..... 343/901, 702
See application file for complete search history.

(56) References Cited

U.S. PATENT DOCUMENTS

| | | | | |
|---|---|---|---|---|
| 4,163,981 | A | 8/1979 | Wilson et al. | |
| 4,435,713 | A * | 3/1984 | Gasparaitis | H01Q 9/30 343/702 |
| 4,794,402 | A | 12/1988 | Gonda et al. | |
| 6,111,549 | A | 8/2000 | Feller et al. | |
| 6,331,838 | B1 | 12/2001 | Scott et al. | |
| 6,778,139 | B2 | 8/2004 | Suzuki et al. | |
| 7,443,361 | B2 | 10/2008 | Haynes et al. | |
| 8,368,603 | B2 | 2/2013 | Huang et al. | |
| 2005/0119026 | A1 * | 6/2005 | Harano | H01Q 1/242 455/556.1 |
| 2006/0022892 | A1 * | 2/2006 | O'Neill, Jr. | H01Q 11/08 343/895 |

(Continued)

FOREIGN PATENT DOCUMENTS

| | | | | |
|---|---|---|---|---|
| EP | 1143557 | A1 * | 10/2001 | H01Q 1/085 |
| GB | 2417834 | A | 3/2006 | |
| WO | WO 2013028052 | A1 * | 2/2013 | H01Q 1/362 |

OTHER PUBLICATIONS

Magnum Electronics, Inc.—Improved Range 800 MHz Antenna—Extracted from website—www.magnumelectronics.com/Motorola—1 page.

*Primary Examiner* — Dieu Hien T Duong
(74) *Attorney, Agent, or Firm* — Barbara R. Doutre

(57) ABSTRACT

An antenna is provided with improved ruggedness and flexibility through the use of an embedded substrate with impedance matching circuitry disposed thereon, and a flexible electrical interconnect. The flexible electrical interconnect is coupled between the substrate and an antenna connector. The antenna comprises a first top flexible section having the flexible radiator element, a second stiff section comprising the impedance matching circuit for multi-band operation, and a third lower flexible section comprising the flexible electrical interconnect. Portable radio products incorporating the antenna can now provide multiband capability along with protection against drop.

32 Claims, 5 Drawing Sheets

(56) References Cited

U.S. PATENT DOCUMENTS

| | | | | |
|---|---|---|---|---|
| 2006/0033673 | A1* | 2/2006 | Cupples | H01Q 1/1214 343/878 |
| 2009/0021445 | A1* | 1/2009 | Knudsen | H01Q 11/083 343/850 |
| 2009/0051609 | A1 | 2/2009 | Packer et al. | |
| 2010/0194664 | A1* | 8/2010 | Blickle | H01Q 1/3275 343/888 |
| 2011/0199280 | A1* | 8/2011 | Nissinen | H01Q 1/243 343/860 |
| 2011/0215987 | A1* | 9/2011 | Ohara | H01Q 1/50 343/906 |
| 2013/0044038 | A1* | 2/2013 | Packer | H01Q 1/242 343/822 |
| 2013/0069835 | A1* | 3/2013 | Swais | H01Q 1/3275 343/715 |

* cited by examiner

MULTI-BAND SUBSCRIBER ANTENNA FOR PORTABLE RADIOS

FIELD OF THE DISCLOSURE

The present invention relates generally to antennas and more particularly to antenna structures for multi-band applications.

BACKGROUND

Communication devices, such as portable two-way radios, which operate over different frequency bands are considered desirable, particularly in the public-safety arena where such devices are used by such agencies as police departments, fire departments, emergency medical responders, and military to name a few. The use of separate antennas to cover different frequency bands is often not a practical option in view of the portability and size limitations of such devices. Multi-band antenna structures can be used to cover multiple bands. The multi-band antenna used on such devices requires a matching network, and this matching network is typically situated on a rigid printed circuit board (PCB) and a rigid attachment to the radio. Unfortunately, these rigid configurations are prone to breakage, particularly in the public safety environment. FIG. 1 is an illustration of a radio 102 with a prior art rigid antenna 104. Examples of rigid antenna breakage are shown at area 106 and area 108.

While epoxy, or other potting compounds, can be added to increase the antenna's toughness, these compounds have been found to degrade antenna performance. The size of the PCB and its matching circuitry have tended to be small in order to minimize damage when dropped. However, the use of small printed circuit boards and small components tend to provide less effective and less efficient antenna performance.

Furthermore, due to the need of public safety personnel to carry a portable two-way radio to operate effectively in dangerous environments, problems with antenna stiffness, protection from drop must be considered in such a design.

Accordingly, there is a need for an improved antenna.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
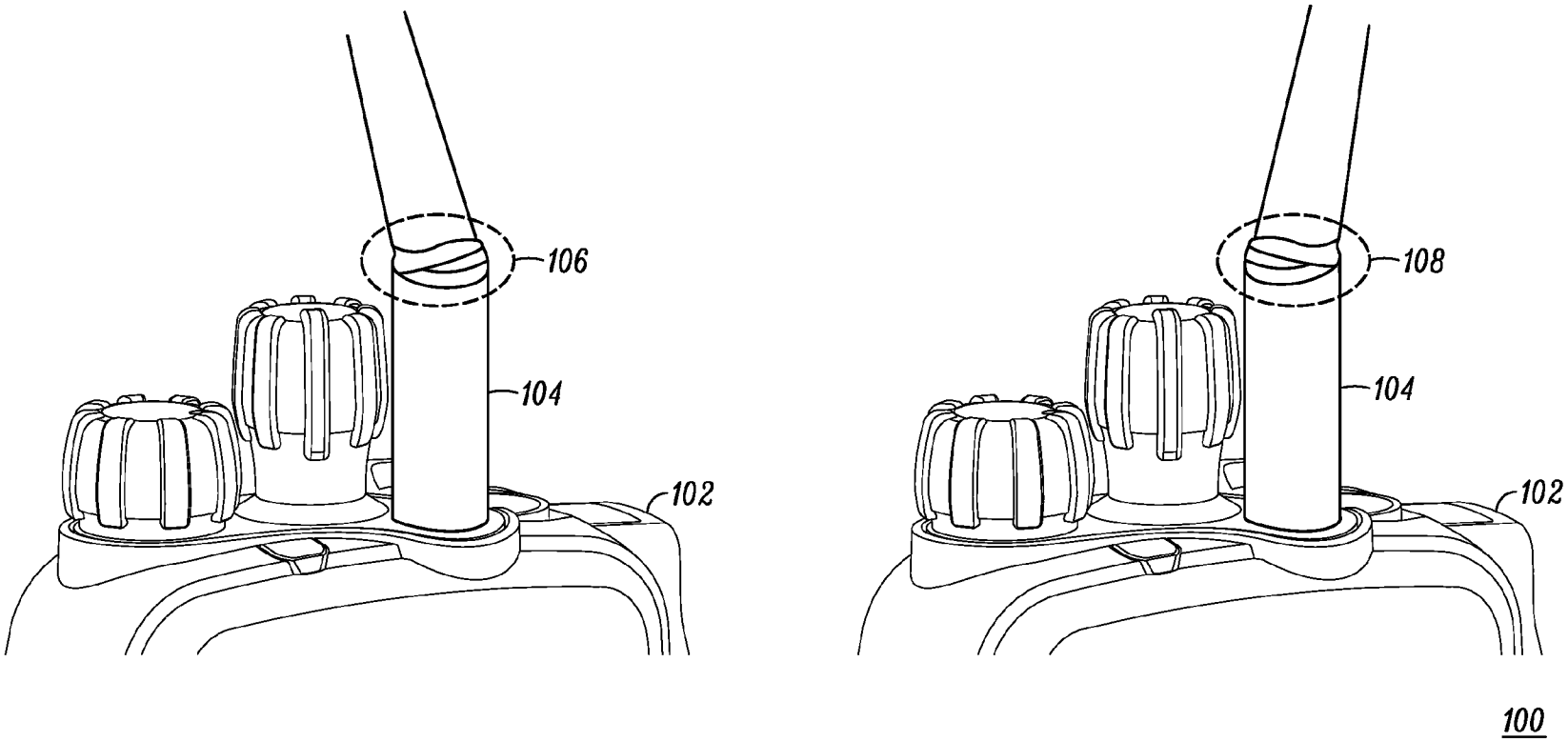
FIG. 1 PRIOR ART
FIG. 1 is an illustration of a radio with a prior art broken antenna.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein an antenna structure with improved ruggedness that functions in multiple bands. An impedance matching circuit is incorporated into the antenna structure. The matching circuit is imbedded between two flexible sections comprising a flexible radiator element and a flexible electrical interconnect. These two flexible sections provide an overall antenna structure with an improved rugged and flexible form factor. The antenna structure is particularly applicable to hand held wireless communication products, such as portable two-way radio subscriber units, where the available volume within the housing of the device is very limited. The single combined structure operates over a plurality of frequency bands, such as very high frequency (VHF) band (about 136-174 MHz), an ultra high frequency (UHF) band (about 380-520 MHz), and a 7/800 MHz frequency band (764-869 MHz). A radio incorporating the new antenna structure is particularly advantageous for public-safety providers (e.g., police, fire department, emergency medical responders, and military) because of its improved ruggedness and flexibility.

Figure 2:
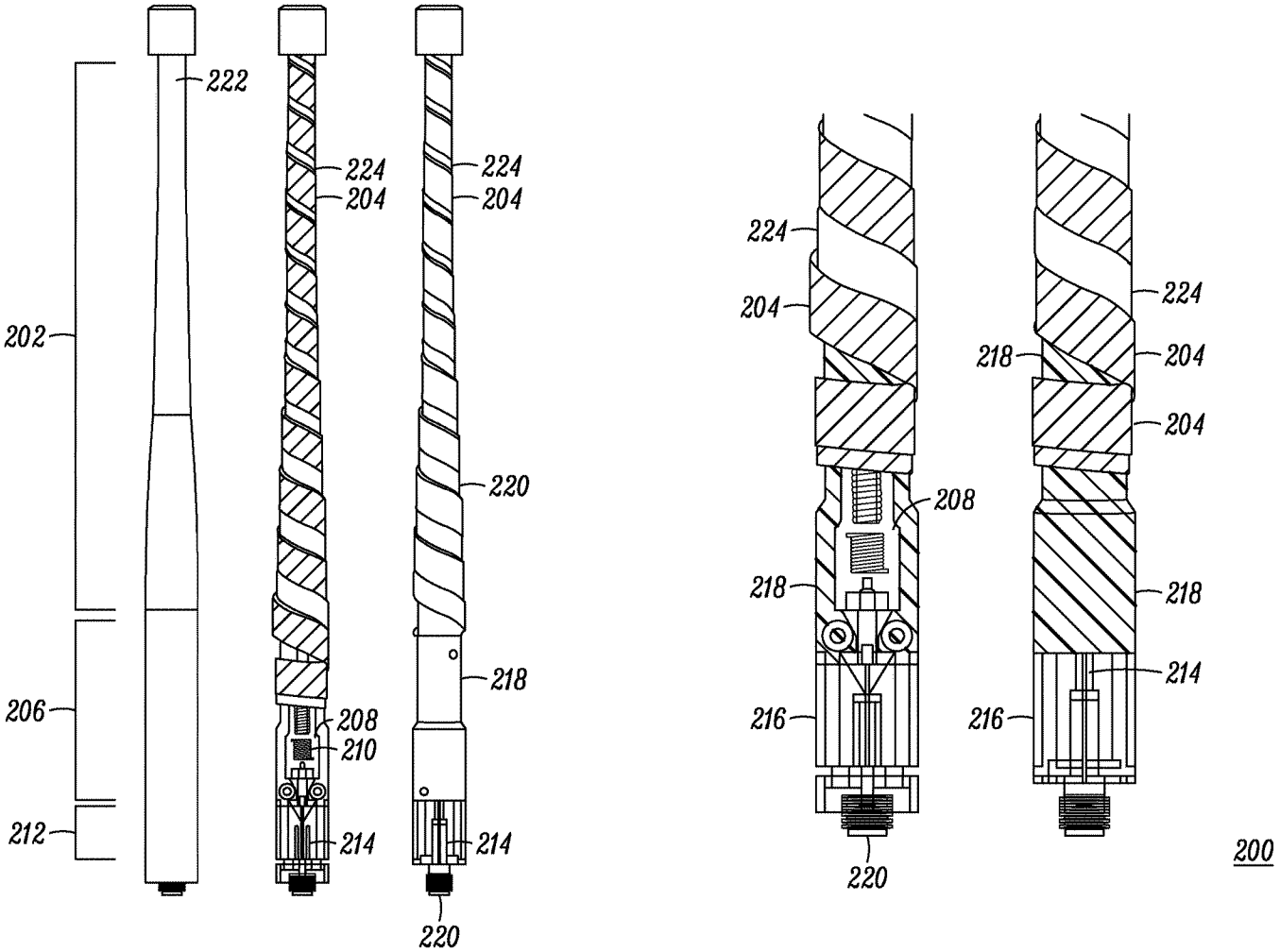
FIG. 2 is an antenna in various states of assembly formed in accordance with various embodiments.

FIG. 2 shows different assembly stages of an antenna 200 formed in accordance with the various embodiments. The components are not drawn to scale with respect to each other in order to facilitate viewing. In accordance with the various embodiments, the antenna 200 comprises a first top flexible section 202 having a flexible radiator element 204, a stiff second section 206 comprising a substrate 208, such as a printed circuit board (PCB) having impedance matching circuitry 210 disposed thereon, and a third lower flexible section 212 comprising a flexible electrical interconnect 214. A flexible rubber coupling 216 surrounds the flexible electrical interconnect. The antenna 200 is overmolded with a suitable overmold material 222.

The antenna 200 may further comprise an attachment means 220, such as a radio frequency (RF) connector or other suitable attachment means, for mounting and coupling the antenna 200 to an electronic product incorporating transceivers that operate in one or multiple radio-frequency (RF) bands. Alternatively, the antenna 200 may be mounted and coupled directly to said electronic product.

The flexible radiator element 204 is formed of a rolled conductive strip having non-overlapping turns providing a helical radiator element located in flexible section 202. The rolled conductive strip may be wound around a flexible rod 224 such as a flexible rod made of silicone, or other suitably non-conductive, flexible elastomeric material with good RF properties, such as low RF losses. Additional details and examples pertaining to the helical formed of the rolled conductive strip can be found in patent application Ser. No. 13/471,721 filed May 15, 2012 which is hereby incorporated by reference. Overlapping turns of the conductive strip are located in stiff section 206. The stiff section 206 leads into the third lower flexible section 212 comprising the flexible electrical interconnect 214. Thus, the antenna formed in accordance with the various embodiments, provides a flexible section (flexible section 202 and flexible section 212) on each side of the stiff section 206 enclosing the matching circuitry.

The antenna 200 comprises a casing 218 for housing the substrate 208 having the impedance matching circuitry 210. The flexible radiator element 204 is coupled to the casing 218 and electrically coupled to the impedance matching circuitry, such as by solder pads or other coupling means at a first end of the casing. The rolled conductive strip of flexible radiator element 204 is wound about the casing 218 and the rod 224 as a single radiator element. Stiff section 206 comprises conductive strip 204 wound around the casing 218 with overlap between successive turns. This stiff section 206 may comprise a non-conductive film, to prevent electrical shorts, between the overlapping successive turns. The rolled conductive strip 204 transitions from the stiff section 206 of overlapping successive turns along the casing 218, to the flexible section 202 of non-overlapping successive turns along the rod 224.

Stiff section 206 comprises casing 218 encasing the substrate 208 having the impedance matching circuitry 210 disposed thereon. The casing 218 may be formed of a rigid plastic or other suitable stiff material for encasing the substrate 208. The flexible electrical interconnect 214 is coupled to the substrate 208 at a second end of the casing 218. The impedance matching circuitry 210 electrically couples through the flexible electrical interconnect 214 to the transceivers of the electronic product to which the antenna 200 will couple.

Stiff section 206 is the section requiring protection from breakage and damage. In accordance with the various embodiments, the flexible electrical interconnect 214 provides such protection. In accordance with the various embodiments, flexible electrical interconnect 214 may comprise a coaxial cable, a strip-line flex, a micro-strip flex circuit. In accordance with the various embodiments, the substrate 208 is located between the two flexible sections 202, 212 thereby providing improved flexibility for the antenna 200. In accordance with the various embodiments, the flexible electrical interconnect 214 bends in response to drop.

In accordance with the various embodiments, antenna 200 provides a flexible structure comprising a substrate with impedance matching circuitry 210 that provides tri-band coverage over the VHF, UHF, and 7/800 MHz frequency bands. Because the embodiments provided herein provide for a more flexible antenna, the size of the PCB can be made advantageously larger, if desired, thus allowing for the use of larger and better spaced components which improves efficiency. The printed circuit board (PCB) substrate providing impedance matching circuitry for the above mentioned bands may be formed such that the length of the PCB may make up between 10 to 40 percent of the overall length of the antenna.

Figure 3:
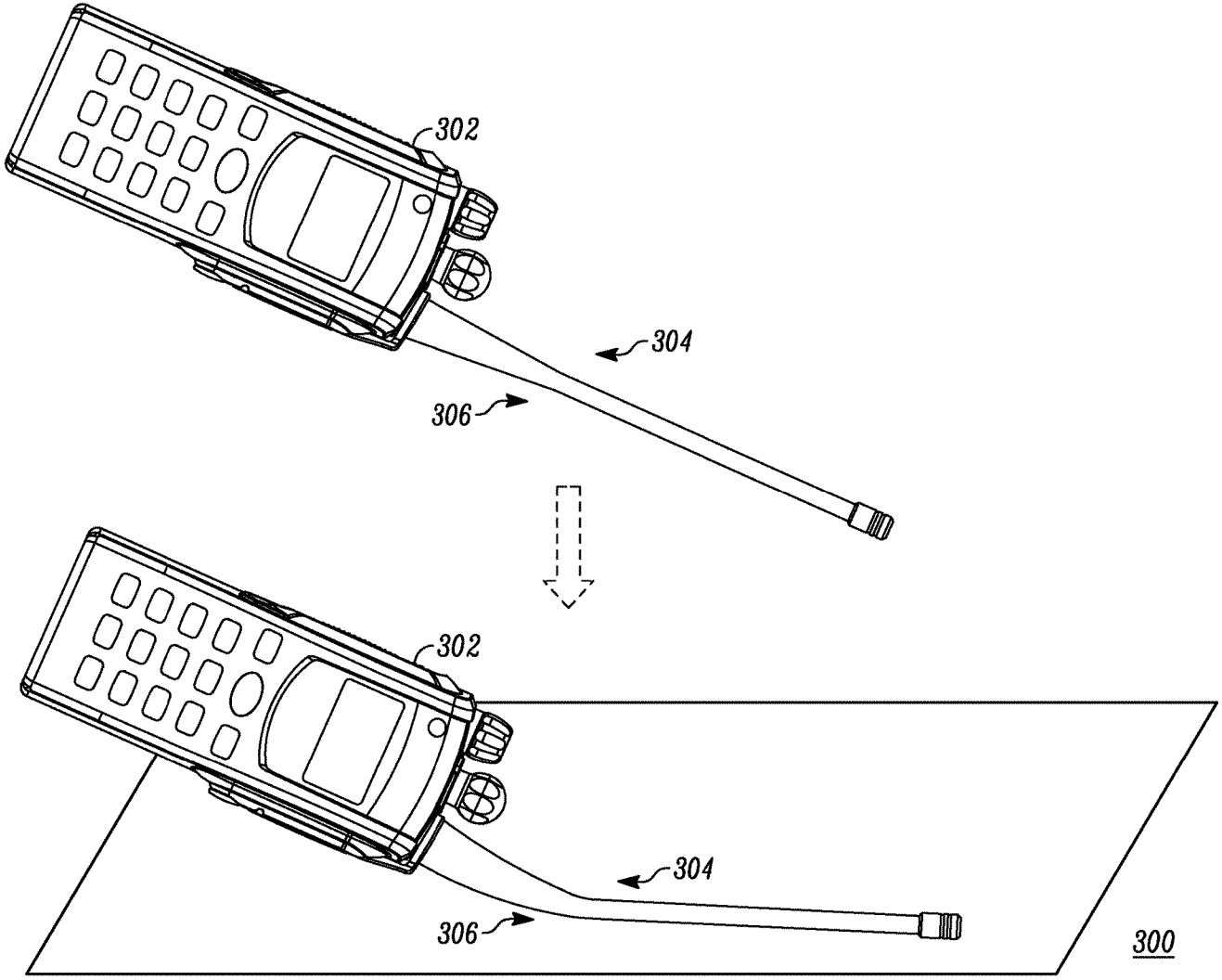
FIG. 3 is a radio having an antenna formed in accordance with the various embodiments.

FIG. 3 is a radio 300 having an antenna 304 formed in accordance with the various embodiments. Radio 300 comprises a radio housing 302 and an antenna 304 formed in accordance with the various embodiments. The antenna 304 comprises a substrate with impedance matching circuitry embedded within the antenna, as previously described. A flexible interconnect feature 306, embedded within the antenna 304, is coupled between the radio housing 302 and the substrate, thus allowing the antenna 304 to bend in response to drop. The substrate and circuitry are thus protected from breakage and cracking. Thus, one of the flexible sections is located between the matching circuitry of substrate 208 and the radio. For example, the flexible electrical interconnect may be coupled between the substrate and a rigid antenna connector. The ability for public safety personnel to carry the portable two-way radio having the flexible antenna formed in accordance with the various embodiments provides protection against drop and access to multi-band operation.

Figure 4:
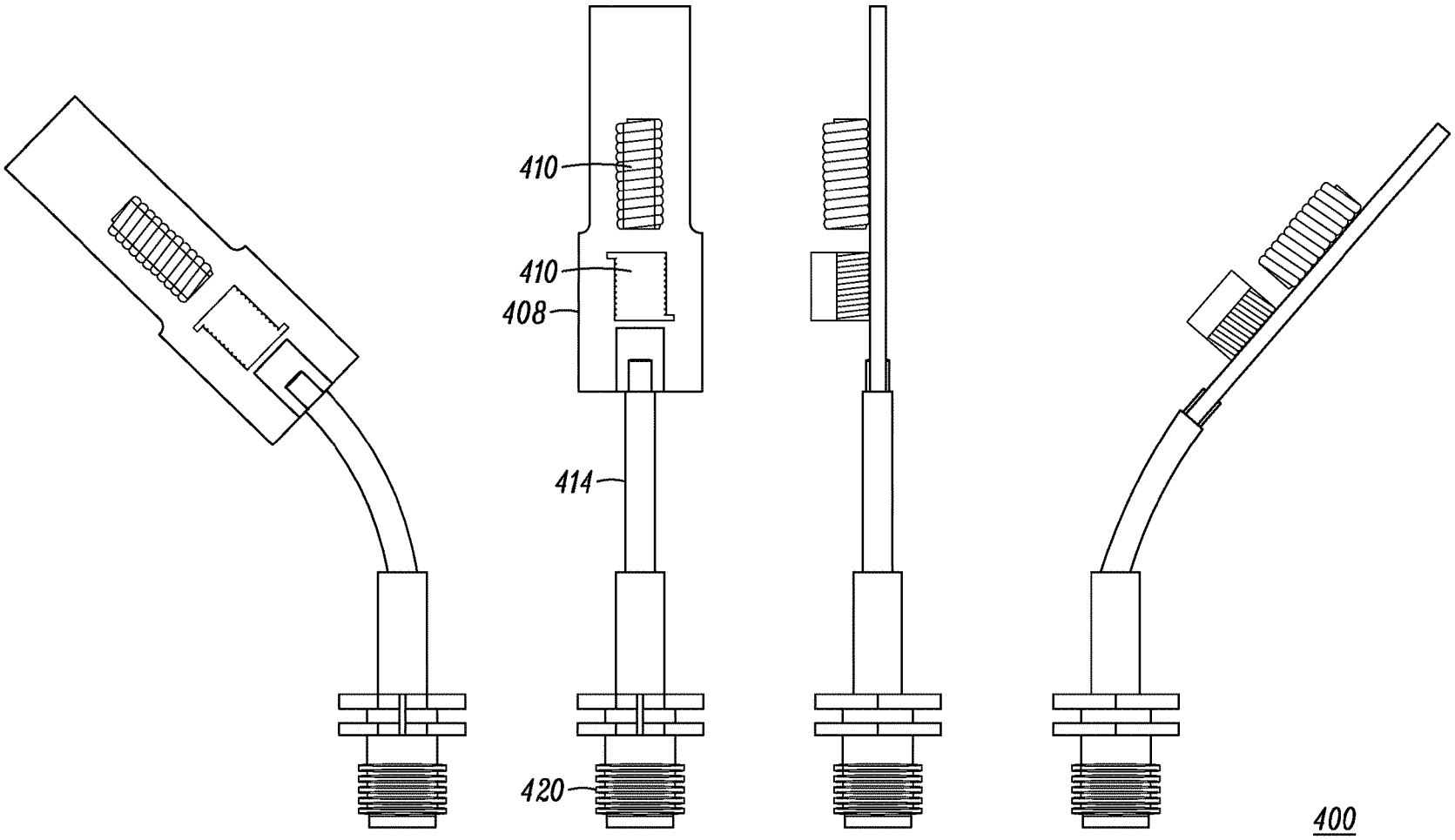
FIG. 4 is a partial assembly view of the antenna formed in accordance with the various embodiments.

FIG. 4 is a partial assembly view of the antenna formed in accordance with the various embodiments. Antenna 400 comprises a flexible electrical interconnect 414 provided here in the form of a coaxial cable. The coaxial cable is coupled to PCB 408 having matching circuitry 410 for multiband operation disposed thereon. In this embodiment a SMA connector 420 in the form of a coaxial connector is provided as an attachment means with which the PCB 408 can be coupled for RF contact at and grounding (GND). FIG. 4 illustrates the bending provided by the flexible electrical interconnect 414 being incorporated into the antenna structure. The flexible electrical interconnect 414 provides predetermined bending between the RF connector and the PCB.

Figure 5:
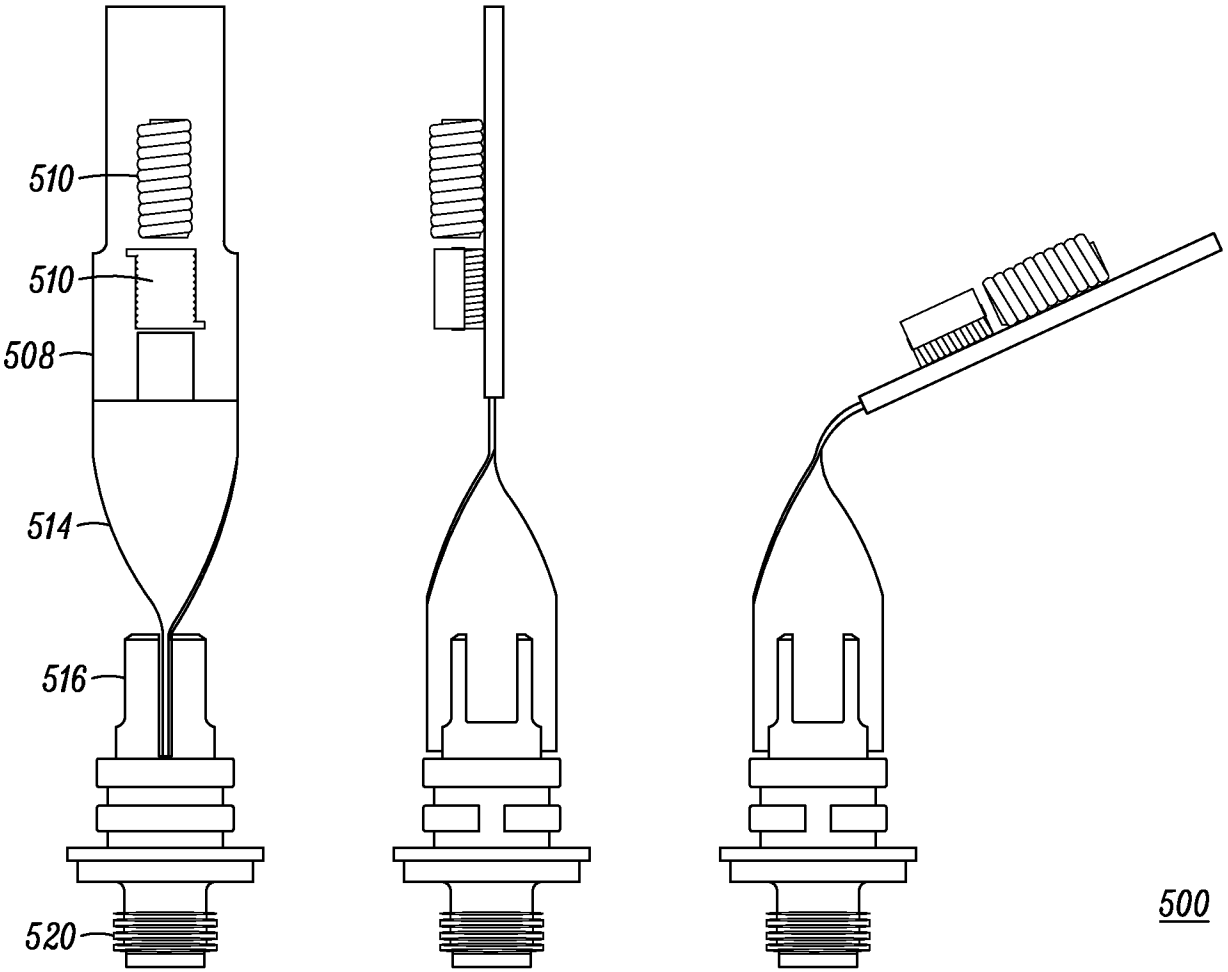
FIG. 5 is another partial assembly view of the antenna formed in accordance with the various embodiments.

FIG. 5 is a partial assembly view of the antenna formed in accordance with the various embodiments. Antenna 500 comprises a flexible electrical interconnect 514 provided here in the form of a flex. The flex is coupled to PCB 518 having matching circuitry 510 for multiband operation disposed thereon. In this embodiment a flex circuit connector 520 is provided as an attachment means providing a pronged fork interface within which the flex 506 can mount for RF contact and grounding. FIG. 5 illustrates the bending provided by the flexible electrical interconnect 514 being incorporated into the antenna structure. The flexible electrical interconnect 514 provides predetermined bending between the RF connector and the PCB.

Accordingly, there has been provided a multi-band subscriber antenna with improved flexibility and robustness. The use of epoxy or other potting compounds has been eliminated. The antenna formed in accordance with the various embodiments may be implemented utilizing larger and better spaced matching components thereby simplifying PCB layout and providing improved performance over multi-band operation. One particularly useful combination of bands desirable to achieve in a portable two-way radio antenna comprises a very high frequency (VHF) band (about 136-174 MHz), an ultra high frequency (UHF) band (about 380-520 MHz), and a 7/800 MHz band (about 764-869 MHz). Other bands could also be desirable, for instance a global positioning system (GPS) band (about 1565-1585 MHz) or a long-term evolution (LTE) public-safety band (about 758-798 MHz). Furthermore, due to the need of emergency personnel to carry a portable two-way radio during an entire work shift and to operate effectively in dangerous environments, problems with antenna stiffness and overall size must be considered in such a design. The top portion is flexible and does not require the use of stiff (multiple turns of wire wrapped around an insulating rod) and does not require the use of a coil. The lower flexible section having the flexible electrical interconnect allows electrical performance to be maintained while providing for protection against drop. The antenna formed in accordance with the various embodiments is independent of the radio housing.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna for a portable radio, the antenna comprising:

a substrate having impedance matching circuitry disposed thereon;

a non-conductive flexible solid rod;

a single flexible helical radiator element wound about the non-conductive flexible solid rod, and the single flexible helical radiator element being coupled to the substrate, the single flexible helical radiator element being electrically coupled to the impedance matching circuitry;

a flexible electrical interconnect coupled to the substrate; and a rigid antenna connector coupled to the flexible electrical interconnect.

2. The antenna of claim 1, wherein the flexible electrical interconnect provides a predetermined bending relative to the rigid antenna connector.

3. The antenna of claim 1, wherein the flexible electrical interconnect comprises at least one of: a coaxial cable, a strip-line flex, a micro-strip flex circuit.

4. The antenna of claim 1, further comprising:

a flexible rubber coupling surrounding the flexible electrical interconnect.

5. The antenna of claim 1, wherein the substrate comprises:

a printed circuit board (PCB), and the impedance matching circuitry is mounted to the PCB.

6. The antenna of claim 5, wherein PCB has an overall length longer than the rigid antenna connector.

7. The antenna of claim 1, wherein the rigid antenna connector comprises a SubMiniature version A (SMA) connector.

8. The antenna of claim 1, wherein the substrate comprises a printed circuit board (PCB) having an overall length making up between 10 and 40 percent of the antenna.

9. The antenna of claim 1, wherein the single flexible helical radiator provides impedance matching for a plurality of different frequency bands (VHF, UHF and 800 MHz).

10. The antenna of claim 1, wherein the antenna is covered in an overmold without the use of potting compounds.

11. The antenna of claim 1, wherein the antenna provides protection against drop.

12. The antenna of claim 1, wherein the single flexible helical radiator element is electrically coupled to the impedance matching circuitry by solder pads.

13. The antenna of claim 1, wherein the single flexible helical radiator element wound about the non-conductive flexible solid rod provide a first top flexible section for the antenna, the impedance matching circuit disposed on the substrate provide a second stiff section of the antenna, and the flexible electrical interconnect provides a third lower flexible section of the antenna.

14. An antenna comprising:

a first top flexible section formed of a single flexible helical radiator element wound about a non-conductive flexible solid rod;

a second stiff section comprising an impedance matching circuit for multi-band operation, the single flexible helical radiator element being electrically coupled to the impedance matching circuit;

a third lower flexible section comprising a flexible electrical interconnect coupled to the second stiff section; and a rigid antenna connector coupled to the flexible electrical interconnect.

15. The antenna of claim 14 wherein the rigid antenna connector comprises a coaxial connector, and the flexible electrical interconnect comprises a coaxial cable.

16. The antenna of claim 14, wherein the rigid antenna connector comprises a flex circuit connector and the flexible electrical interconnect comprises a flex.

17. The antenna of claim 14, the impedance matching circuit provides tri-band coverage over: VHF (136-174 MHz), UHF (380-520 MHz), and 764-869 MHz.

18. The antenna of claim 14, wherein the flexible electrical interconnect provides predetermined bending.

19. A portable radio, comprising:

a portable radio housing;

a radio frequency (RF) connector coupled to the portable radio housing;

an antenna coupled to the RF connector, the antenna comprising:

a flexible electrical interconnect coupled to the RF connector;

a printed circuit board (PCB) having impedance matching circuitry disposed thereon, the PCB being coupled to the flexible electrical interconnect;

a non-conductive flexible solid rod;

a casing for encasing the PCB, the non-conductive flexible solid rod being coupled to a first end of the casing, and the flexible electrical interconnect being coupled to a second end of the casing;

and a single flexible helical radiator element coupled to the PCB with the impedance matching circuitry providing tri-band coverage.

20. The radio of claim 19, wherein the single flexible helical radiator element coupled to the PCB, comprises:

a rolled conductive strip coupled to the PCB, the rolled conductive strip being wound with overlapping successive turns about the casing; and the rolled conductive strip being wound with non-overlapping successive turns about the non-conductive flexible solid rod.

21. The radio of claim 20, wherein the single flexible helical radiator element provides predetermined bending between the RF connector and the PCB.

22. The radio of claim 19, wherein the single flexible helical radiator element and impedance matching circuitry of the radio provides tri-band coverage over: VHF (136-174 MHz), UHF (380-520 MHz), and 764-869 MHz.

23. The portable radio of claim 19, wherein the antenna provides protection against drop.

24. The portable radio of claim 19, wherein the single flexible helical radiator element is electrically coupled to the impedance matching circuitry by solder pads.

25. The portable radio of claim 19, wherein the single flexible helical radiator element wound about the non-conductive flexible solid rod provide a first top flexible section for the antenna, the impedance matching circuit disposed on the substrate provide a second stiff section of the antenna, and the flexible electrical interconnect provides a third lower flexible section of the antenna.

26. A portable radio, comprising:

a portable radio housing;

an antenna comprising:

a non-conductive flexible solid rod;

a single flexible helical radiator wound about the non-conductive flexible solid rod;

a substrate with impedance matching circuitry, the substrate being embedded within the antenna; and a flexible electrical interconnect coupled between the portable radio housing and substrate, wherein the single flexible helical radiator element with impedance matching circuitry provides tri-band coverage of VHF (136-174 MHz), UHF (380-520 MHz), and 764-869 MHz.

27. The radio of claim 26, wherein the flexible electrical interconnect is embedded in the antenna.

28. The portable radio of claim 26, wherein the antenna provides protection against drop.

29. The portable radio of claim 26, wherein the single flexible helical radiator element is electrically coupled to the impedance matching circuitry by solder pads.

30. The portable radio of claim 26, wherein the single flexible helical radiator element wound about the non-conductive flexible solid rod provide a first top flexible section for the antenna, the impedance matching circuit disposed on the substrate provide a second stiff section of the antenna, and the flexible electrical interconnect provides a third lower flexible section of the antenna.

31. An antenna for a portable radio, the antenna comprising:

first and second flexible sections with a stiff section coupled therebetween, the first flexible section comprising a flexible non-conductive solid rod having a single flexible helical radiator element wrapped thereon, the stiff section comprising a substrate with impedance matching circuitry electrically coupled to the single flexible helical radiator element, and the second flexible section comprising a flexible bendable electrical interconnect coupled to the substrate; and a rigid antenna connector coupled to the bendable flexible electrical interconnect.

32. The antenna of claim 31, further comprising:

a casing for encasing the substrate and impedance matching circuitry of the stiff section in between the first and second flexible sections.

* * * * *